US008330561B2

(12) United States Patent
Schön

(10) Patent No.: US 8,330,561 B2
(45) Date of Patent: Dec. 11, 2012

(54) CAVITY FILTER, AN ISOLATION DEVICE, AND A NODE IN A MOBILE COMMUNICATIONS NETWORK

(75) Inventor: Lennart Schön, Sundbyberg (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 845 days.

(21) Appl. No.: 12/280,454

(22) PCT Filed: Feb. 24, 2006

(86) PCT No.: PCT/SE2006/050013

§ 371 (c)(1),
(2), (4) Date: Dec. 1, 2008

(87) PCT Pub. No.: WO2007/097669

PCT Pub. Date: Aug. 30, 2007

(65) Prior Publication Data

US 2009/0167464 A1 Jul. 2, 2009

(51) Int. Cl.
*H01P 1/20* (2006.01)
*H01P 7/06* (2006.01)

(52) U.S. Cl. ..... 333/203; 333/232; 333/224

(58) Field of Classification Search ..... 333/202, 333/206, 207, 222–226, 232
See application file for complete search history.

(56) References Cited

U.S. PATENT DOCUMENTS

| | | | | |
|---|---|---|---|---|
| 2,514,428 | A * | 7/1950 | Varian et al. | 315/5.23 |
| 3,929,023 | A | 12/1975 | Ambruoso | |
| 5,748,060 | A | 5/1998 | Sarkka | |
| 6,057,748 | A * | 5/2000 | Hsing et al. | 333/224 |
| 6,362,708 | B1 * | 3/2002 | Woods | 333/234 |
| 6,847,269 | B2 * | 1/2005 | Watanabe et al. | 333/126 |
| 7,385,155 | B2 | 6/2008 | Trivette et al. | |

* cited by examiner

*Primary Examiner* — Benny Lee
*Assistant Examiner* — Gerald Stevens
(74) *Attorney, Agent, or Firm* — Roger S. Burleigh

(57) ABSTRACT

The invention relates to a cavity filter comprising at least one tuning conductor (3) presenting a hollow portion (4), an isolation device (6) for a tuning conductor (3) of a cavity filter, and a node in a mobile communications network, comprising a cavity filter. According to the invention, the tuning conductor (3) comprises an isolation device (6) in a non-conductive material, which isolation device (6) is at least partly inserted into the hollow portion (4), and an insertion element (7) in a conductive material presenting a male thread (7*a*) that is engaged with an inner surface of the isolation device (6).

6 Claims, 2 Drawing Sheets

CAVITY FILTER, AN ISOLATION DEVICE, AND A NODE IN A MOBILE COMMUNICATIONS NETWORK

TECHNICAL FIELD

The invention relates to a cavity filter comprising at least one tuning conductor presenting a hollow portion, an isolation device for a tuning conductor of a cavity filter, and a node in a mobile communications network, comprising a cavity filter.

BACKGROUND

Cavity filters are used in a variety of applications, for example in nodes of mobile communications networks, specially in radio base stations. Such filters are tuned before put into operation, and a common approach to do so is to adjust a tuning conductor provided at each cavity, for example a centre conductor in the middle of the respective cavity, and/or a lid conductor between two respective cavities. Tuning of such a filter is accomplished by small individual movements of the tuning conductors, thereby changing the magnetic field in the filter.

In known solutions, the tuning conductors are provided in the form of male screws, inserted into female threads at the cavities of the filter. Such solutions include providing the screw with a locking-nut, or a self-locking screw. In the latter case, the screw is provided in the form of a male-threaded part in plastic material, inside of which part, two metal elements are provided. The plastic material provides an isolation between the metal elements and the chassis or lid of the filter. The screws are moved so as to tune the filter, by turning them in the respective female threads of the filter. Thereby, a suitable tool, such as a screwdriver, is used.

A problem with such solutions is that they require high tolerances in the production of the filter. One circumstance that makes it difficult to reach these tolerance requirements, is that silver plating, done on the chassis of the filter during manufacturing, tends to vary and build sharp edges on the female threads. In the case of the self-locking screw, the tolerance requirements are particularly high, since the screw and the corresponding the female thread, in order to achieve a spring action or friction for locking the screw, present an increased diameter at a respective mid-portion thereof.

SUMMARY

An object of the present invention is to simplify the manufacturing of a cavity filter.

This object is reached with a cavity filter comprising at least one tuning conductor presenting a hollow portion, characterised in that the tuning conductor comprises an isolation device in a non-conductive material, which isolation device is at least partly inserted into the hollow portion, and an insertion element in a conductive material presenting a male thread that is engaged with an inner surface of the isolation device.

Providing an insertion element in a conductive material presenting a male thread that is engagable with an inner surface of the isolation device in a non-conductive material, means that the insertion element and the isolation device can be provided as two separate parts, and that the tuning operation can be carried out by moving one in relation to the other. Also, the insertion element can be provided as a standard screw. Thus, the invention lowers the tolerance requirements and costs compared to known solutions, since the two parts can be obtained by very simple and cost effective manners.

Preferably, at least a major portion of the outer surface of the isolation device is straight in a direction parallel to a longitudinal direction of the isolation device. Thereby, during filter assembly, the isolation device can be easily inserted in the hollow portion by a simple push action. Preferably, the straight portion of the outer surface of the isolation device has a circumference that is slightly larger that the circumference of an inner surface of the hollow portion, so as to provide friction in order to retain the isolation device in the hollow portion. This makes it possible to provide the hollow portion with a, as opposed to known solutions with a threaded hole. Thereby, tolerance problems with such female threads, described above, will be eliminated. A hole having a surface that is straight in a longitudinal direction thereof makes tolerance control much easier than a threaded hole. Generally a very tolerance insensitive, and cost effective arrangement is provided compared to known solutions.

Preferably, an outer surface of the isolation device is at least partly non-cylindrical, and at least partly complementary to an inner surface of the hollow portion. This will prevent rotation of the isolation device when the insertion element is rotated in it.

Preferably, the insertion element is movable in the isolation device by being turned around an axis of its thread.

Preferably, the isolation device is made in a ductile material, suitably in a plastic material. As explained closer below, this will provide friction between the isolation device and the insertion element, so as to lock the latter. Preferably, the isolation device is provided with at least one internal elevation, which could be elongated and extends in a longitudinal direction of the isolation device. As explained closer below, this will further secure friction between the isolation device and the insertion element.

DESCRIPTION OF THE FIGURES

Below, the invention will be described in detail with reference to the drawings, in which.

DETAILED DESCRIPTION

Figure 1:
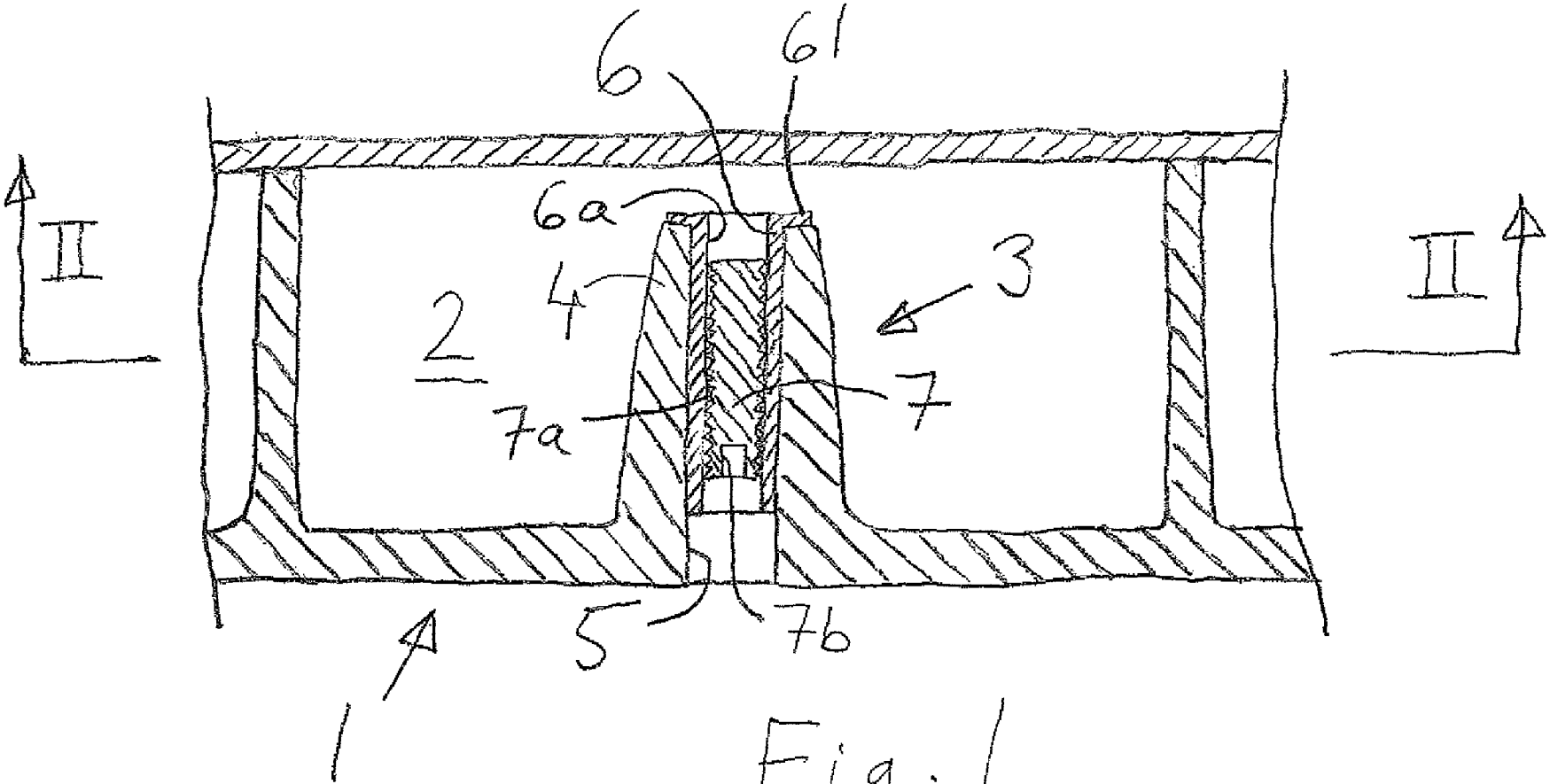
FIG. 1 shows a cross-sectional view of a part of a cavity filter 1 according to one embodiment of the invention.

FIG. 1 shows a cross-sectional view of a part of a cavity filter 1 according to one embodiment of the invention. The cavity filter presents, as is known in the art, a plurality of cavities, of which one 2 is shown in FIG. 1. In each cavity a tuning conductor 3, in the form of a centre conductor 3, is provided. Tuning conductors can alternatively or additionally be provided, as is known in the art, between cavities 3 of the filter 1.

The tuning conductor 3 comprises a hollow portion 4, and a hollow isolation device 6 in the form of a tubular device 6, in a non-conductive material. The tubular device 6 is inserted into the hollow 5 of the hollow portion 4, and is provided with a flange 61 at one of its end to position it in the hollow 5. The tuning conductor 3 also comprises an insertion element 7 in a conductive material presenting a male thread 7*a* that is engagable with an inner surface 6*a* of the tubular device 6. The insertion element 7 also presents at one end a cavity 7*b*, in itself of any known type, adapted to receive a tool, for example a screw driver, for turning the insertion element 7 in relation to the tubular device 6, and thereby displace it in the longitudinal direction of the tubular device 6. The insertion element 7 can alternatively present a cavity 7*b* at each end thereof.

Figure 2:
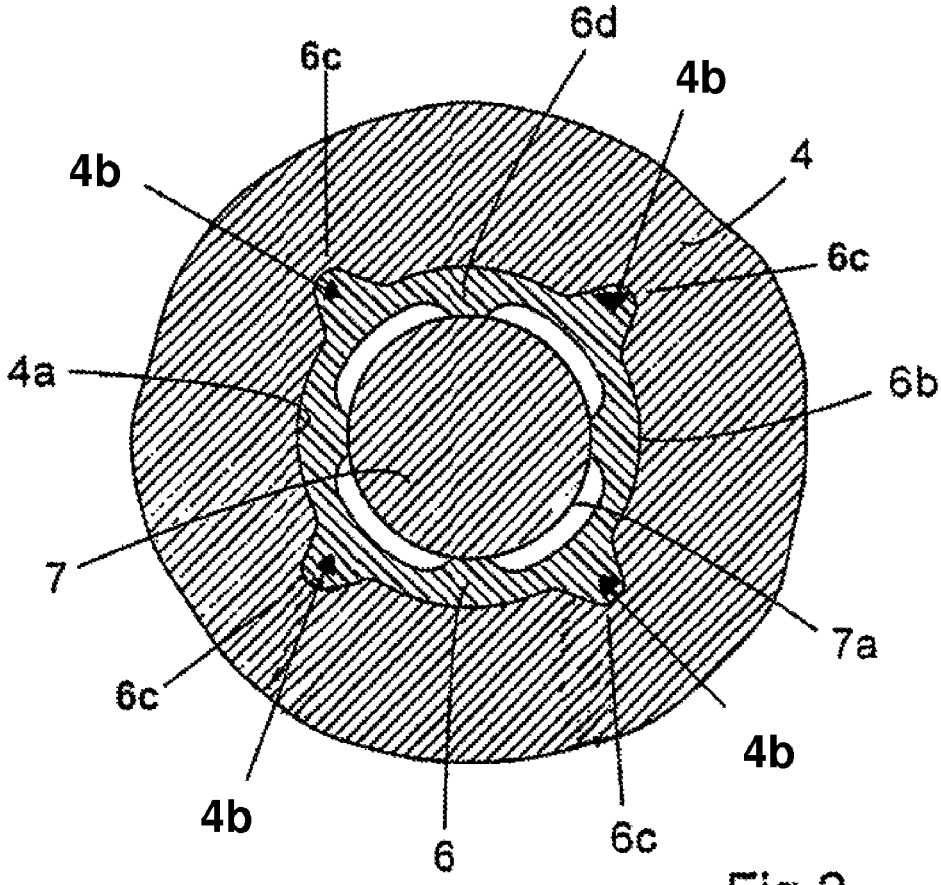
FIG. 2 shows, enlarged in relation to FIG. 1, a cross-sectional view, sectioned along the line II-II in FIG. 1.

Reference in made to FIG. 2. The outer surface 6*b* of the tubular device 6 is partly non-cylindrical. More specifically, it presents part-circular portions connected by elongated elevations 6*c*, extending in the longitudinal direction of the tubular device 6. An inner surface 4*a* of the hollow portion 4 is complementary to the outer surface 6*b* of the tubular device 6, and elongated pockets 4*b* of the inner surface 4*a* of the hollow portion 4 are adapted to receive respective elevations 6*c* of the tubular device 6. Thereby, rotation of the tubular device 6 in relation to the hollow portion 4 is prevented. Alternative embodiments can include other complementary cross-sectional shapes of the outer and inner surfaces 6*b*, 4*a* of the isolation device 6 and the hollow element 4, respectively. Such cross-sectional shapes could be elliptic, hexagonal, octogonal, or any other non-circular shape to prevent rotation of the isolation device 6 is relation to the hollow element 4.

The tubular device 6 is made in a relatively ductile material, more specifically a suitable plastic material, and can be produced for example by injection moulding. This will provide a deep engagement of the thread 7*a* of the insertion element 7, and thereby a relatively high friction between the insertion element 7 and the tubular device 6, so that the former is locked to the latter.

To further increase the engagement of the insertion element 7, the tubular device 6 is provided with internal elevations 6*d*, which are elongated and extend in the longitudinal direction of the tubular device 6. Alternatively, the internal elevations 6*d* of the isolation device 6 can be provided in any number and in a variety of manners, for example as elongated, spirally extending, internal elevations, or as a plurality of local elevations, for example each in the form of a bump.

Figure 3:
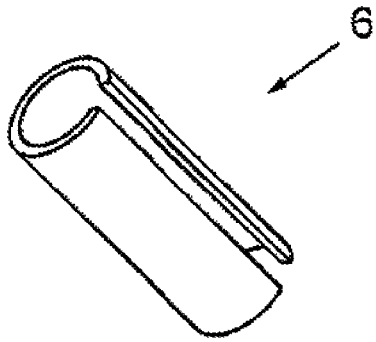
FIG. 3 shows a perspective view of an alternative embodiment of an isolation device for a tuning conductor of a cavity filter.

The isolation device 6 can be provided in a variety of manners. FIG. 3 shows an alternative embodiment of the isolation device 6, in the form of a slotted tube.

The invention claimed is:

1. A cavity filter, comprising:

a body forming a cavity therein;

a tuning structure extending into said cavity and having a hollow portion with an opening to the outside of said body;

a non-conductive isolation member press-fitted through said opening into said hollow portion of said tuning structure, wherein an outer periphery of said isolation member has a non-circular cylindrical profile about a central axis that is substantially complementary to an inner wall of said hollow portion of said tuning structure, said isolation member having a longitudinal internally-threaded portion along said central axis; and, a conductive insertion element inserted into said internally-threaded portion of said isolation member, said insertion element having an external thread complementary to the internally-threaded portion of said isolation member, wherein said insertion element can be selectively rotated within said isolation member to alter operation of said cavity filter.

2. The cavity filter recited in claim 1, wherein the isolation member is made of a ductile material.

3. The cavity filter recited in claim 1, wherein the isolation member is made of a plastic material.

4. A method for constructing a cavity filter, said filter including a body forming a cavity therein and a tuning structure extending into said cavity and having a hollow portion with an opening to the outside of said body, said method comprising the steps of:

press fitting a non-conductive isolation member through said opening into said hollow portion of said tuning structure, wherein an outer periphery of said isolation member has a non-circular cylindrical profile about a central axis that is substantially complementary to an inner wall of said hollow portion of said tuning structure, said isolation member having a longitudinal internally-threaded portion along said central axis; and, inserting a conductive insertion element into said internally-threaded portion of said isolation member, said insertion element having an external thread complementary to the internally-threaded portion of said isolation member, whereby said insertion element can be selectively rotated within said isolation member to alter operation of said cavity filter.

5. The method recited in claim 4, wherein the isolation member is made of a ductile material.

6. The method recited in claim 4, wherein the isolation member is made of a plastic material.

* * * * *